US010222132B2

(12) United States Patent
Lester et al.

(10) Patent No.: US 10,222,132 B2
(45) Date of Patent: Mar. 5, 2019

(54) HEAT TRANSFER APPARATUS

(71) Applicants: Flint Engineering Ltd., Mayfield (GB); Econotherm UK Limited, Bridgend (GB)

(72) Inventors: Stephen Lester, Mayfield (GB); Hussam Jouhara, Manchester (GB)

(73) Assignee: Flint Engineering Ltd., Mayfield (GB)

( * ) Notice: Subject to any disclaimer, the term of this patent is extended or adjusted under 35 U.S.C. 154(b) by 0 days.

(21) Appl. No.: 15/319,374

(22) PCT Filed: Jun. 19, 2015

(86) PCT No.: PCT/GB2015/051796

§ 371 (c)(1),
(2) Date: Dec. 16, 2016

(87) PCT Pub. No.: WO2015/193683

PCT Pub. Date: Dec. 23, 2015

(65) Prior Publication Data

US 2017/0146300 A1 May 25, 2017

(30) Foreign Application Priority Data

Jun. 19, 2014 (GB) ..... 1410924.3

(51) Int. Cl.
*F28D 15/00* (2006.01)
*F28F 3/12* (2006.01)
(Continued)

(52) U.S. Cl.
CPC ..... *F28D 15/0233* (2013.01); *F28D 15/025* (2013.01); *F28D 15/0283* (2013.01);
(Continued)

(58) Field of Classification Search
CPC .... F28D 15/0266; F28D 15/04; F28D 15/043; F28D 15/06; F28D 2015/0291; F28F 3/12
(Continued)

(56) References Cited

U.S. PATENT DOCUMENTS 468,050 A * 2/1892 Trabold ..... F28F 3/12 122/208
5,960,866 A 10/1999 Kimura et al.
(Continued)

FOREIGN PATENT DOCUMENTS

CN 103727686 A 4/2014
DE 102008026505 A1 2/2010
(Continued)

OTHER PUBLICATIONS

International Search Report and Written Opinion for PCT/GB2015/051796, dated Nov. 30, 2015 (18 pages).
(Continued)

*Primary Examiner* — Jason Thompson
(74) *Attorney, Agent, or Firm* — Patent Law Works LLP

(57) ABSTRACT

Apparatus comprises: a panel (100) having first and second main faces (101, 102); and a sealed system internal within the panel and comprising plural passages (103) each extending from a first manifold cavity (107) at a first end of the panel to a second manifold cavity (107) at a second end of the panel and containing a fluid in both gas and liquid states, wherein each of the passages includes one or more protruding features (122, 123, 124) on a side of the passages that is closer to the first main face.

20 Claims, 9 Drawing Sheets

(51) Int. Cl.

| | |
|---|---|
| ***F28D 15/02*** | (2006.01) |
| ***F28F 1/40*** | (2006.01) |
| ***F28F 3/04*** | (2006.01) |
| ***F28F 1/04*** | (2006.01) |

(52) U.S. Cl.
CPC ..... *F28F 1/04* (2013.01); *F28F 1/40* (2013.01); *F28F 3/048* (2013.01); *F28F 3/12* (2013.01)

(58) Field of Classification Search
USPC ..... 165/104.28, 104.31, 272, 104.21
See application file for complete search history.

(56) References Cited

U.S. PATENT DOCUMENTS

| | | | | |
|---|---|---|---|---|
| 6,966,359 | B1 | 11/2005 | Liu | |
| 2002/0033250 | A1 | 3/2002 | Chuang | |
| 2004/0108105 | A1 | 6/2004 | Dwyer | |
| 2005/0241806 | A1* | 11/2005 | Liu | F28D 15/0266 165/104.21 |
| 2005/0274505 | A1* | 12/2005 | Laurila | F28F 3/12 165/168 |
| 2008/0264611 | A1* | 10/2008 | Chang | H01L 21/4882 165/104.26 |
| 2010/0038066 | A1* | 2/2010 | Yang | F28F 13/00 165/185 |
| 2010/0326644 | A1* | 12/2010 | Hung | F28D 15/0233 165/185 |
| 2012/0145358 | A1* | 6/2012 | Moon | B21C 23/085 165/104.26 |
| 2012/0186787 | A1* | 7/2012 | Dinh | F24F 12/002 165/104.26 |
| 2017/0108243 | A1* | 4/2017 | Qu | F24J 2/0007 |

FOREIGN PATENT DOCUMENTS

| | | | |
|---|---|---|---|
| EP | 0567393 | A1 | 10/1993 |
| EP | 0826527 | A2 | 3/1998 |
| EP | 2390609 | A2 | 11/2011 |
| GB | 2498373 | A | 7/2013 |
| JP | 2011122813 | A | 6/2011 |
| WO | 2013104884 | A1 | 7/2013 |

OTHER PUBLICATIONS

Examination Report for EP Application No. 15741245.3, dated Apr. 17, 2018, 6 pgs.

* cited by examiner

HEAT TRANSFER APPARATUS

CROSS REFERENCE TO RELATED APPLICATIONS

This application is a National Stage of International Application No. PCT/GB2015/051796 filed Jun. 19, 2015, entitled "Heat Transfer Apparatus," which claims priority to Great Britain Application 1410924.3 filed Jun. 19, 2014, all of which are hereby incorporated by reference in their entirety.

FIELD OF THE INVENTION

The present invention relates to a heat transfer apparatus.

BACKGROUND TO THE INVENTION

A heat pipe is a hermetically sealed, evacuated tube comprising a working fluid in both the liquid and vapour phase. When one end of the tube is heated the liquid turns to vapour upon absorbing the latent heat of vaporization. The hot vapour subsequently passes to the cooler end of the tube where it condenses and releases the latent heat to the tube. The condensed liquid then flows back to the hot end of the tube and the vaporization-condensation cycle repeats. Since the latent heat of vaporization is usually very large, considerable quantities of heat can be transferred along the tube and a substantially uniform temperature distribution can be achieved along the heat pipe.

Referring to FIG. 8, there is illustrated a known heat pipe heat exchanging arrangement 10 for exchanging heat, and more particularly absorbing heat from a planar surface (not shown). The exchanger 10 comprises a plurality of heat pipes 11 which are coupled along a proximal portion 11*a* thereof to a rear face of a panel 12. The heat pipes 11 are arranged in a substantially parallel configuration and extend along the length of the panel 12. The panel 12 is arranged to absorb heat from the planar surface (not shown) and the heat absorbed is communicated to the proximal portion 11*a* of the heat pipes 11 which causes the fluid (not shown) disposed therein to turn to a vapour.

The distal portion 11*b* of the pipes 11 are arranged to extend within a flow duct 13 along which a cooling fluid (not shown) is arranged to pass, so that the vapour which passes to the distal portion 11*b* of the pipes 11 can condense. The condensate, namely the cooled working fluid, can subsequently return to the proximal portion 11*a* of the heat pipes 11 for further absorption of heat from the panel 12. In this respect, the cooling fluid (not shown) can be arranged to extract the heat absorbed by the working fluid so that the heat pipes 11, and in particular, the fluid disposed within the heat pipes 11 can continue to absorb heat. A problem with this arrangement however, is that the temperature of the working fluid within the heat pipes 11 rises during use, which reduces the ability of the fluid to absorb further heat from the panel 12. Furthermore, it is often difficult to separately seal the distal portion 11*b* of each heat pipe 11 to the flow duct 13, with the result that the cooling fluid can leak out of the duct.

WO 2013/104884 discloses a heat exchanger for exchanging heat with a medium across a substantially planar surface. This is shown in FIG. 9. The exchanger 900 comprises: a heat exchanging panel 901; a fluid circuit comprising a first chamber 904 disposed at a first end of the panel 901, a second chamber 905 disposed at a second end of the panel 101, a plurality of passages 903 which extend along the panel between the first and second chambers 904, 905, and a duct 907 which extends between the first and second chamber 904, 905; a fluid disposed within the circuit; wherein, the plurality of passages 903 are arranged in thermal communication with the panel 901 and are arranged to communicate the fluid from the first chamber 904 to the second chamber 905, and the duct 907 is arranged to communicate fluid from the second chamber 905 to the first chamber 904.

SUMMARY OF THE INVENTION

The invention provides apparatus comprising:

a panel (100) having first and second main faces (101, 102); and a sealed system internal within the panel and comprising plural passages (103) each extending from a first manifold cavity (107) at a first end of the panel to a second manifold cavity (107) at a second end of the panel and containing a fluid in both gas and liquid states, wherein each of the passages includes one or more protruding features (122, 123, 124) on a side of the passages that is closer to the first main face.

The protruding features may include one or more ribs extending lengthways in the passages. Here, at least some of the one or more ribs may be generally triangular and/or at least some of the one or more ribs may be generally square.

The second main face (102) may include longitudinally extending undulations that correspond to locations of the passages. Here, the thickness of the panel may be greater at locations that correspond to locations of the passages compared to locations that do not correspond to locations of the passages and/or the undulations may have a generally sinusoidal cross section.

A main body of the panel may be formed of extruded material.

main body of the panel may be aluminium or an aluminium alloy.

The panel may comprise a main body and first and second manifolds, which contribute to defining the first and second manifold cavities, may be coupled to the main body.

A cross sectional area of the manifold cavities may be 50-200% of the cross sectional area of the passages.

The apparatus may comprise a first heat exchanger element (130) thermally coupled to the panel adjacent the first end thereof.

The apparatus may comprise a second heat exchanger element (131) thermally coupled to the panel adjacent the second end thereof.

An area of coupling between the heat exchanger element and the heat mat may constitutes 5-40% of the area of the main face of the heat mat to which the heat exchanger element is coupled.

The heat exchanger element may be coupled to the second main face of the heat mat.

Each of the passages may include more protruding features (122, 123, 124) on the side of the passages that is closer to the first main face relative to a side of the passages that is closer to the second main face.

BRIEF DESCRIPTION OF THE FIGURES

Embodiments of the invention will now be described, by way of example only, with reference to the accompanying drawings in which.

DETAILED DESCRIPTION OF SOME EMBODIMENTS OF THE INVENTION

Figure 1:
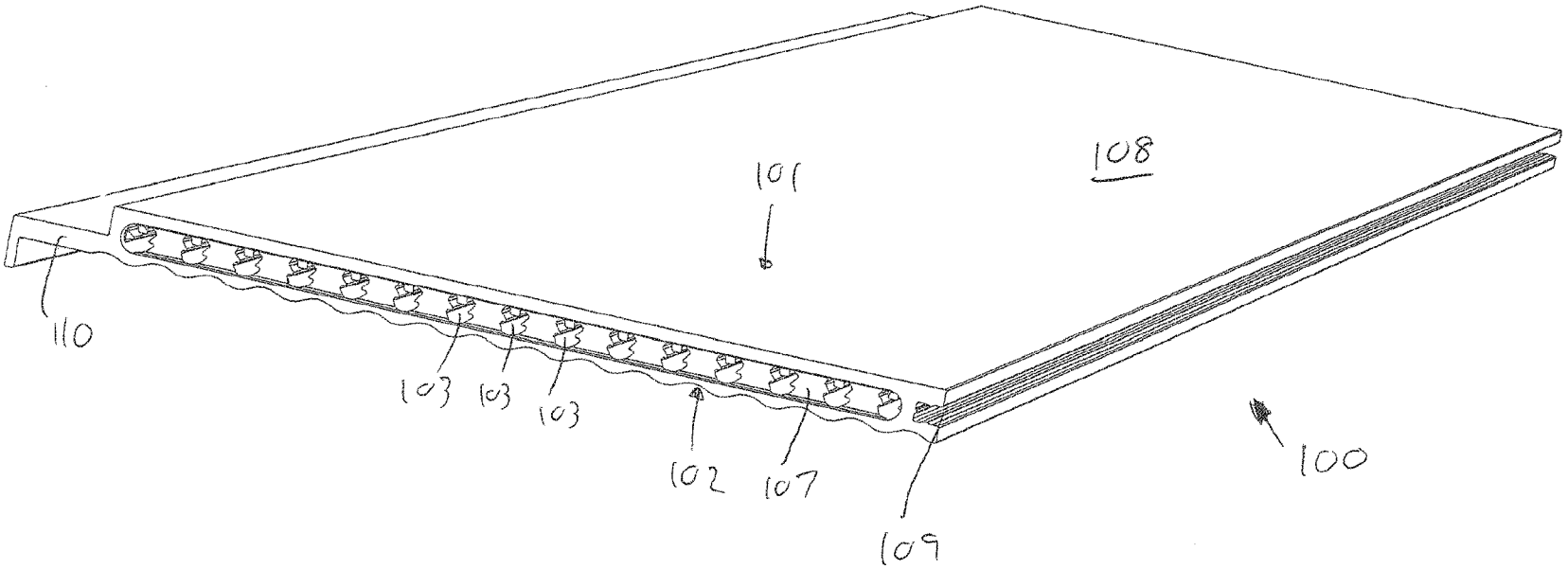
FIG. 1 is an isometric view of part of a heat mat according to embodiments of the invention.

Referring firstly to FIG. 1, part of a heat mat 100 according to embodiments of the invention is shown in isometric view. The heat mat 100 comprises a main body 108 having two main faces, namely an exterior face 101, which is uppermost shown in FIG. 1, and an interior face 102, which is not visible in FIG. 1.

The heat mat 100 is generally rectangular in shape. The heat mat 100 is formed from a suitable material, for instance aluminium.

Extending within the heat mat main body 108 are plural passages 103, ends of which are visible in FIG. 1. The passages 103 are equally spaced across the width of the heat mat 100. The configuration of the passages 103 is described in more detail below, particularly with reference to FIG. 4.

Along one edge of the heat mat main body 108 is provided a connecting slot 109, which can receive a corresponding rib of another heat mat 100 so as to allow the connection of multiple heat mats together. At the edge of the heat mat 100 that is opposite the connecting slot 109 is provided a bracket 110, to allow the heat mat 100 to be connected to a supporting structure or other component.

At the ends of the heat mat main body 108 are provided manifold receiving channels 107, one of which is visible in FIG. 1. The manifold receiving channel 107 takes the form of a recess, trench or channel. The sides of the manifold which is in channel 107 are separated from the end of the exterior face 101 and from the end of the interior face 102 respectively. Ends of the manifold receiving channel 107 are separated from a bottom of the connecting slot 109 and from the bracket 110 respectively. The footprint of the manifold receiving channel 107 includes all of the passages 103 therein. The bottom of the manifold receiving channel 107 is in this example planar and lies in a plane that is generally perpendicular to the main plane of the heat mat main body 108. The exterior face 101 of the heat mat main body 108 is generally planar, and as is best seen in FIG. 1.

Figure 2:
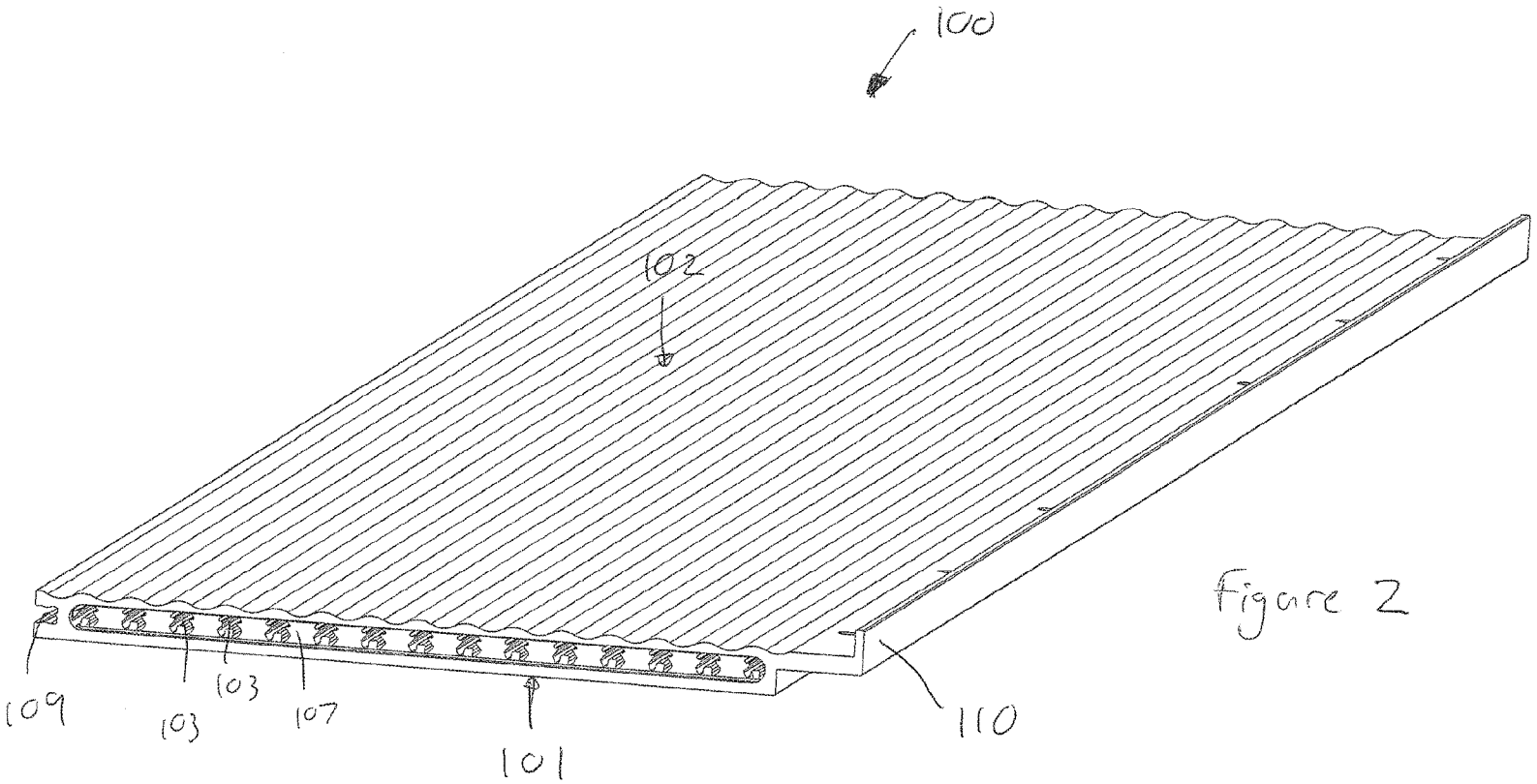
FIG. 2 is an alternative isometric view of the FIG. 1 heat mat, from below with respect to FIG. 1.

As is best seen in FIG. 2, the interior face 102 has an undulating form. Peaks and troughs of the undulations run parallel to the passages 103. The peaks and troughs of the undulations of the interior face 102 extend to the entire length of the heat mat main body 108. As is best seen from FIG. 3 and 4, the peaks of the undulations of the interior face 102, at which point the heat mat main body 108 has the greatest thickness, coincide with the passages 103. Correspondingly, the troughs of the undulations of the interior face 102, which correspond to the lowest thickness of the heat mat main body 108, correspond to the positions between the passages 103. The undulations are generally sinusoidal. The undulations have rotational symmetry about a point that is midway between a peak and a trough.

FIG. 2 also shows the manifold receiving channel 107 at the opposite end of the heat mat main body 108 to the manifold receiving channel 107 that is shown in FIG. 1. FIG. 2 also shows other details of the profile of the bracket 110.

Figure 3:
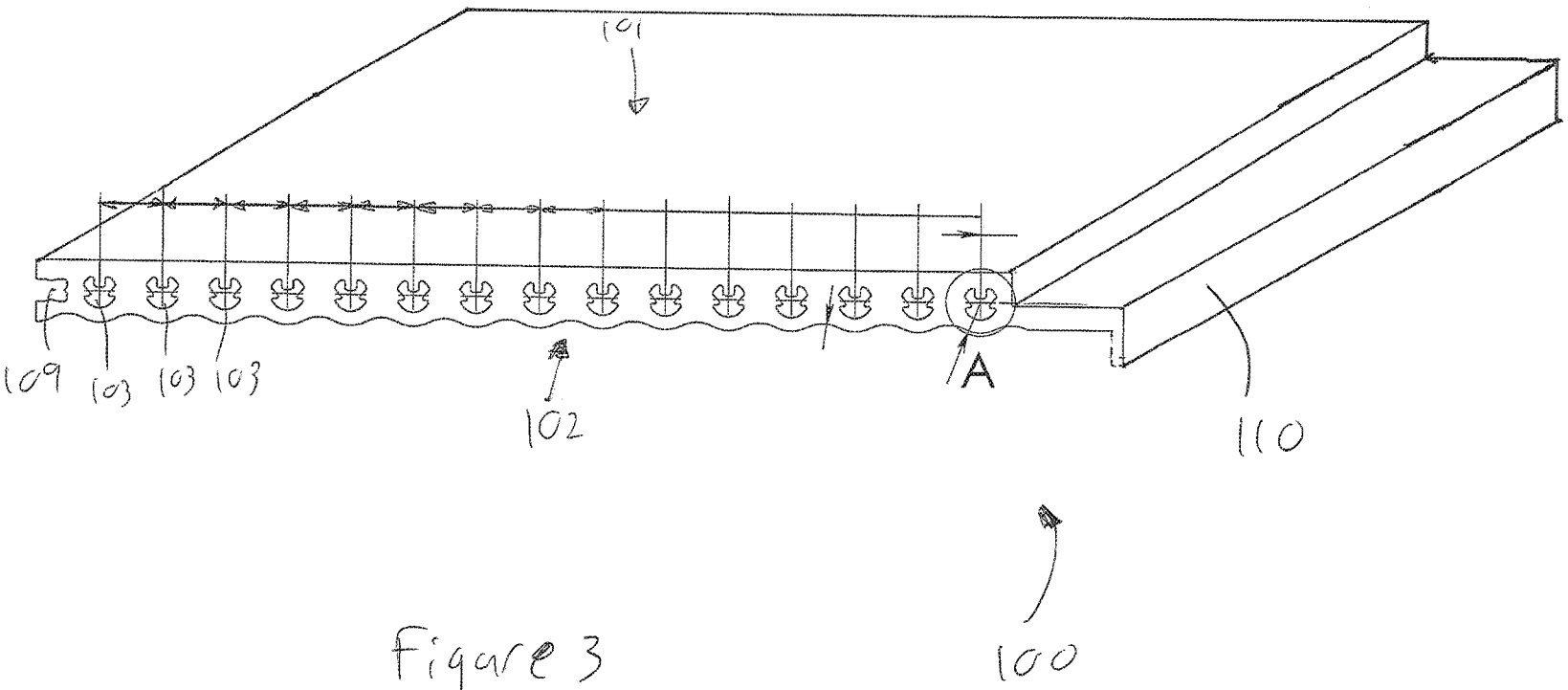
FIG. 3 is a hybrid cross-section of the heat mat of FIGS. 1 and 2.

FIG. 3 is in part a section taken through the heat mat of FIGS. 1 and 2. FIG. 3 shows the profiles of the passages 103 more clearly, in particular because the manifold receiving channel 107 is not shown.

Figure 4:
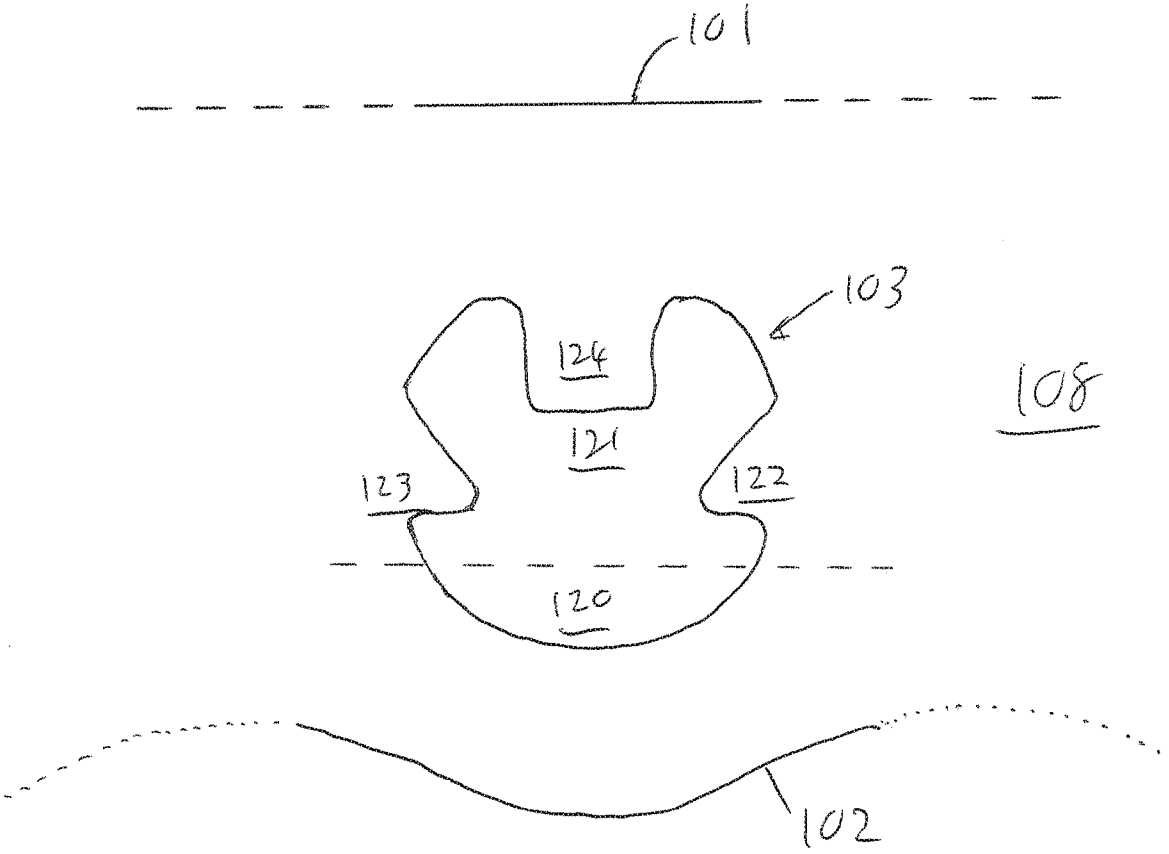
FIG. 4 is an end view of a detail of the FIG. 3 heat mat part.

As can be seen most clearly from FIG. 4, the passage 103 has a generally circular shape and includes a number of features. The passage 103 can be divided conceptually into two parts: a phase-change portion 121 and a drain channel 120. The divider between the drain channel 120 and the phase-change portion 121 is a straight line that is horizontal in FIG. 4. This straight line that divides the drain channel 120 from the phase-change portion 121 is shown as a bass line in FIG. 4. The divider is located approximately one quarter of the distance between the part of the passage 103 that is furthest from the exterior face 101 and the part of the passage 103 that is closest to the exterior face 101. However, the divider could instead be located anywhere between 10% and 50% of the way along the depth of the passage as defined from the part of the passage 103 that is most distant from the exterior face 101 and the part of the passage 103 that is closest to the exterior face 101.

As can be seen in FIG. 4, the drain channel 120 has a regular profile, in particular a part circular profile (it forms a segment of a circle). The phase-change portion 121 however has an irregular profile. In particular, the phase-change portion 121 includes two triangular ribs 122, 123 that extend inwards with respect to the circle forming the general boundary of the passage 103. The phase-change portion 121 also includes a square rib 124, that extends inwardly of the circle forming the general profile of the passage 103.

An effect of the ribs 122, 123, 124 is to provide an increased surface area between the material of the heat mat main body 108 and the cavity that is the passage 103. The surface area of the phase-change portion 121 is greater per unit volume than the surface area of the drain channel 120. Put another way, the ratio of the surface area of the phase-change portion 121 to the volume of the phase-change portion is greater than the ratio of the surface area to volume of the drain channel 120. The triangular ribs have a greater surface area to mass ratio yet are relatively simple to manufacture. The triangular ribs 122, 123 have a greater surface area to mass ratio yet are relatively simple to manufacture. The square rib 124 has a good surface area to mass ratio and is very simple to manufacture reliably. The significance of the ribs is explained below.

Another effect is provided by the ribs 123, 122. In particular, these ribs 122, 123 provide some separation between the drain channel and the phase-change portion 121. These ribs 122, 123 partially close the drain channel 120 from the phase-change portion 121. In the cross-section view, it can be seen that the ribs 122, 123 provide a 'harbour wall' type arrangement, sheltering the drain channel from any turbulence in the phase-change portion 121. The ribs 122, 123 also help to control the flow of condensate down the drain channel when the heat mat is arranged vertically. The partial separation of the drain channel 120 from the phase-change portion 121 by the ribs 122, 123 helps to prevent blockages within the passage 103 and contributes to maximising the rate of heat energy transfer by the heat mat 100.

The ribs 122, 123, 124 are constructed so as to facilitate straightforward manufacture of the heat mat 100. In particular, corners of the ribs are filleted. Also, the thicknesses of the ribs are sufficiently high that they can be reliably formed through a manufacture without breakage.

The passages 103 have an overall width of approximately 5.5 mm and a cross sectional area of approximately 20 $mm^2$. Approximately 15% of the area of a circle including the passages is occupied by the volume of the ribs 12-124. The volume of the circle including the passages that is occupied by the volume of the ribs may be for instance 5-35%.

Figure 5:
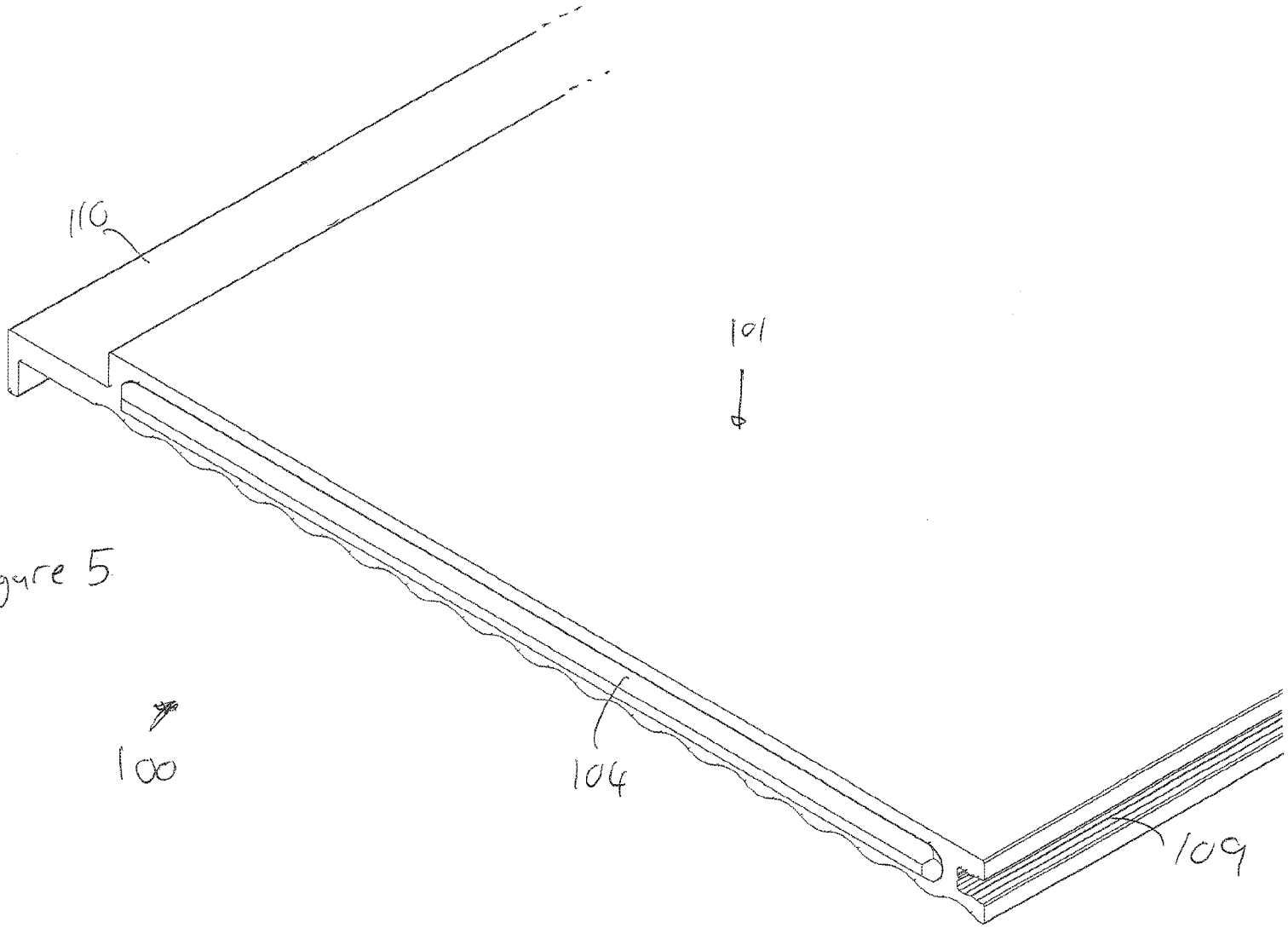
FIG. 5 is a heat mat according to embodiments of the invention and including the heat mat part of FIG. 1 with a manifold.
Figure 6:
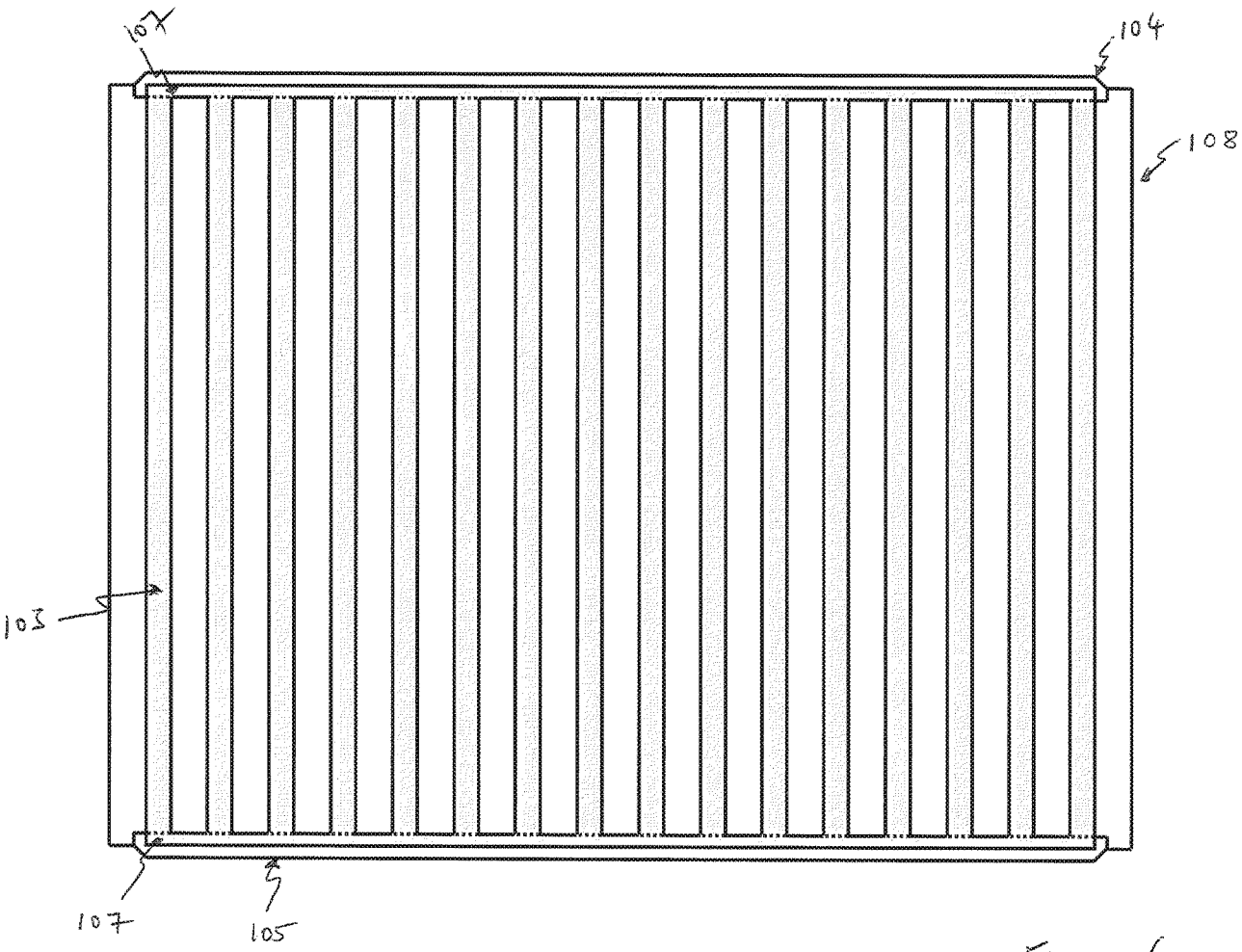
FIG. 6 is a first cross-section through the heat mat according to embodiments of the invention.
Figure 7:
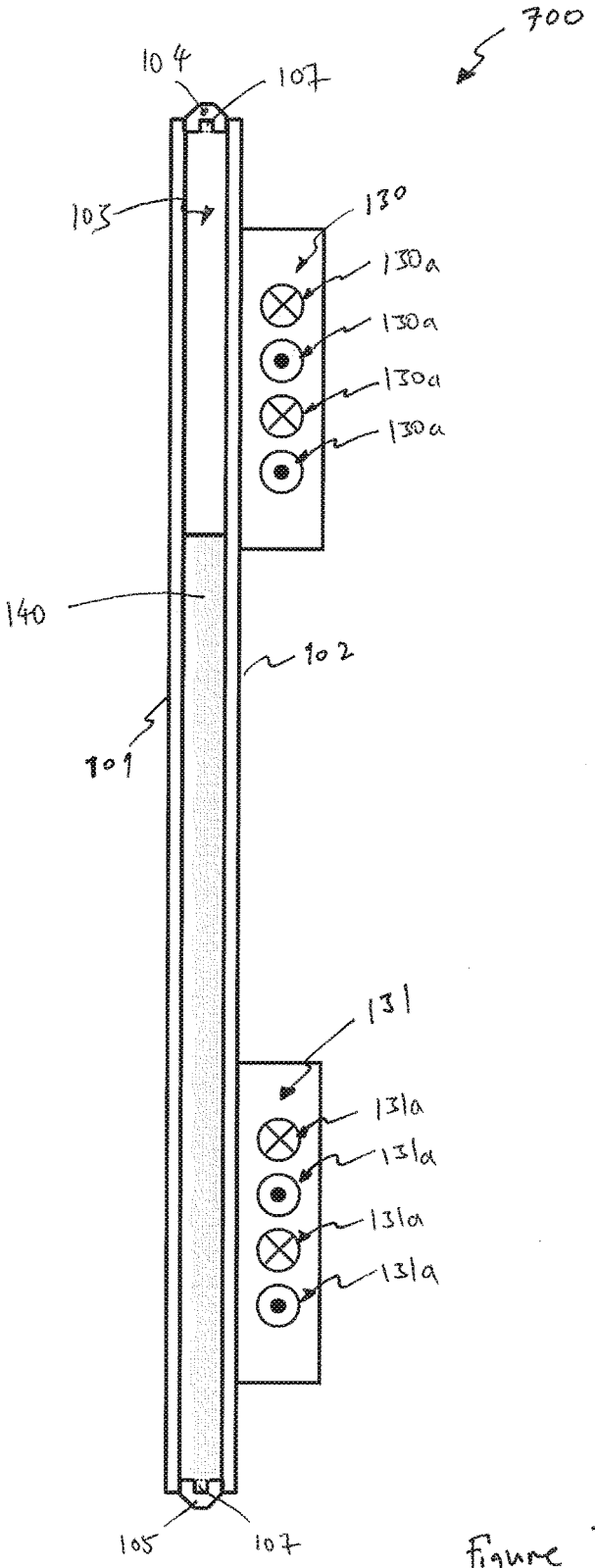
FIG. 7 is a different cross-section through the heat mat according to embodiments of the invention, with first and second heat exchange elements fitted.
Figure 8:
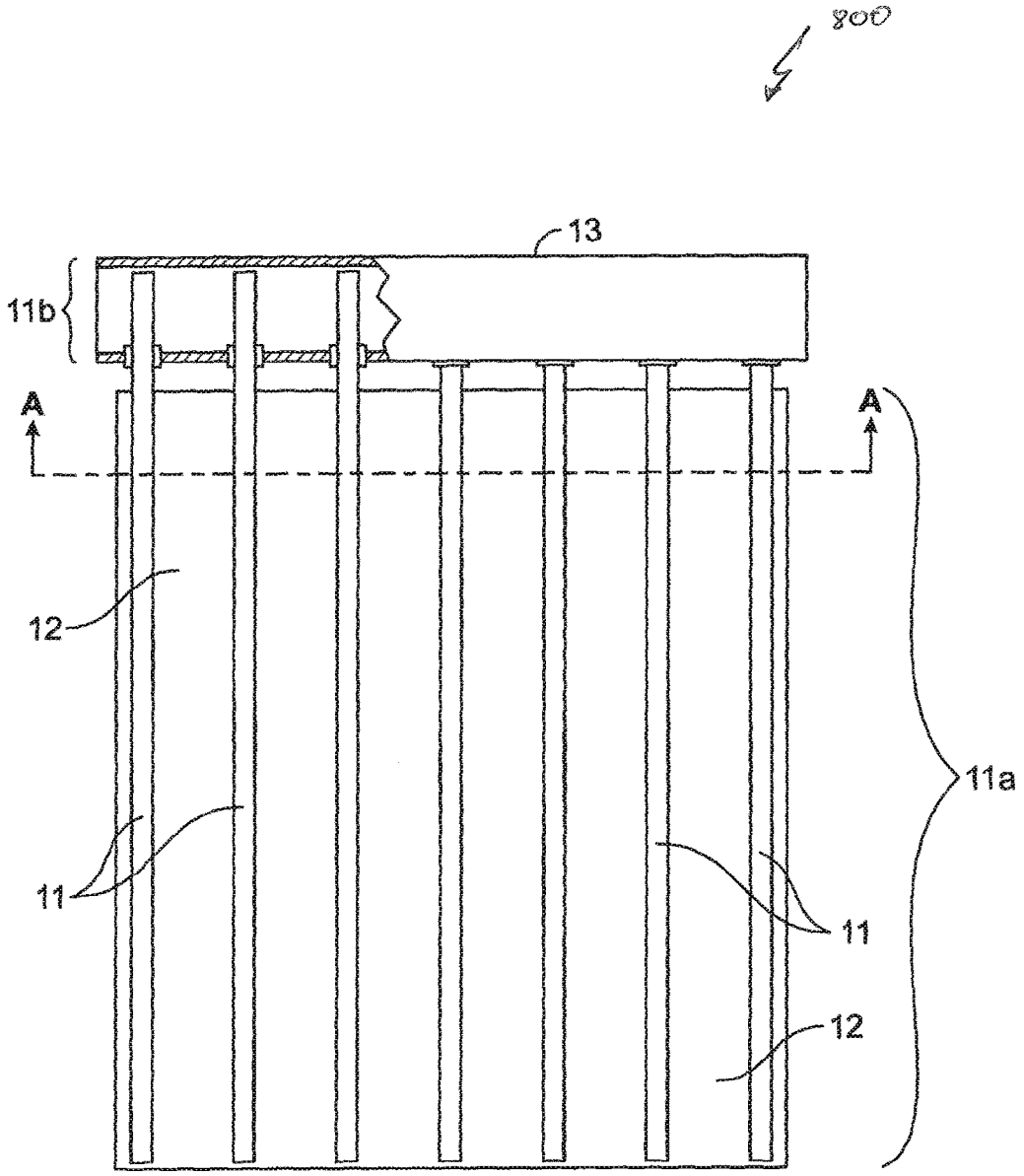
FIG. 8 is a prior art heat pipe heat exchanging arrangement.

As is best seen in FIG. 5 , one manifold 104, 105 is provided at each end of the heat mat main body 108. FIG. 5 shows an upper manifold 104. The upper manifold 104 is provided within the manifold receiving channel 107. The upper manifold 104 is the same as the lower manifold 105, that is provided at the other end of the heat mat main body 108. Each of the manifolds 104, 105 includes a manifold channel 106, which is best seen in FIG. 6 and FIG. 7. The manifold channel 106 serves to connect the passages 103, to allow fluids to flow between the passages 103. The provision of upper and lower manifolds 104, 105 means that all of the passages 103 are connected together at their upper ends and at their lower ends.

The manifolds 104, 105 are substantially straight. The manifolds 104, 105 are formed of the same material as the heat mat main body 108. The manifold 104, 105 is designed to fit snugly within the manifold receiving channel 107 of the heat mat main body 108. Interference fitting, welding or gluing can be used to embed the manifold onto the heat mat main body 108, in the process forming a sealed chamber within the heat mat 100. The manifold 104, 105 has a substantially straight channel running along the entire length of the inner face (i.e. the face that is facing the open passages 103). The channel has a rectangular cross-section, although it may instead be for instance part-circular for better pressure characteristics. The effect of this channel is to commonly terminate all the passages 103 as shown in FIG. 6, allowing the working fluid to pass through freely and equalising the pressure when the heat mat is in operation. The external surface of the manifold 104 (i.e. the face that is facing outwards of the heat mat 100) has a generally triangular profile. The material of the manifold 104, 105 is of a suitable minimum thickness, for instance 2 mm or 2.5 mm.

The height of the manifold channel 106 may be smaller than the width of the passages 103. The main effect of the manifold channel 106 is to allow pressure to be equalised between the ends of the passages 103. The cross-sectional area of the manifold channel may alternatively be approximately the same as the cross-sectional area of the passages. The cross sectional area of the manifold cavities may for instance be 50-200% the cross sectional area of the passages The passages 103 within the heat mat main body 108 are commonly terminated at each end of the heat mat main body 108 by the manifolds 104 and 105, sealing the passages 103 which in turns form a liquid- and gas-tight chamber as shown in FIG. 6. The manifolds 104, 105 can be mounted on the heat mat main body 108 by interference fitting or bonding, for example. Advantageously, the mechanical mounting of the manifolds 104, 105 on the heat mat main body 108 also forms the seal.

In use, the heat mat 100 is positioned vertically or at an incline from vertical. This allows gravity to be used to pass liquid from an upper part of the heat mat 100 to a lower part, as is described below.

The interior cavities of the heat mat 100, comprising the passages 103 and the manifold channels 106, are provided with a volume of fluid. In particular, some of the fluid is in liquid phase and some of the fluid is in gas phase. Because the upper and lower manifolds 104 and 105 are sealed within the manifold receiving channels 107 of the heat mat main body 108, the cavity comprising the passages 103 and the manifold channels 106 form a closed pressure system. The pressure within the cavity may be above or below atmospheric pressure, depending on the choice of fluid. As seen in FIG. 7, a reservoir of the liquid phase 140 of the fluid is located at the bottom part of the cavity, and in particular extends part-way up the passages 103, and fluid in the gas phase 141 is at the top of the cavity. Consequently, the manifold channel 106 of the lower manifold 105 is filled with the liquid phase 140 of the fluid and the manifold channel 106 of the upper manifold 104 is filled with the gas phase 141 of the fluid.

A first heat exchange element 130 is fitted to the interior face 102 of the heat mat 100. In particular, the first heat exchange element is located at an upper portion of the heat mat 100. In this particular example, all of the functional part of the first heat exchange element is located more than half-way up the height of the heat mat 100.

Within the first heat exchange elements there are provided one or more conduits 130*a*. The conduits extend perpendicularly to the cross-section of FIG. 7, and two out and two return portions are illustrated in the figure with the use of a cross and a dot respectively in the conventional way.

A second heat exchange element 131 is provided on the interior face 102 of the heat mat 100. The second heat exchange element 131 is provided at a lower portion of the heat mat 100. In this example, all of the functional part of the second heat exchange element is formed below the half-way point of the heat mat 100.

The second heat exchange element 131 includes conduits 131*a*, which have the same form in this example as the conduits 130*a* of the first heat exchange element 130.

The heat exchanger elements 130, 131 are sized such that an area of coupling between the heat exchanger element 130, 131 and the heat mat constitutes 5-40% of the area of the interior surface 102 of the heat mat 100. In these examples, the heat exchanger elements 130, 131 have one undulating surface all or almost all of which is in thermal contact with the heat mat 100.

The heat mat 100 may for instance be extruded, fabricated cast, pressed or manufactured in a combination of these methods. The heat exchanging elements 130, 131 can be held against the heat mat 100 using mechanical fixings e.g. bolts, screws, clamps etc bonded with adhesives, welded or affixed in any other way which allows good mechanical contact for thermal transfer.

Contained within the sealed chamber is a working fluid that is fundamental to the heat exchanging process. There are a multitude of working fluid that can be used including water, ammonia, acetone, alcohols and blends thereof, the efficacy of these are driven by the conditions in which the panel is used. The skilled person will be able to identify suitable fluids for any given set of working conditions.

Referring to FIG. 7, a heat energy transfer system capable of absorbing and/or emitting thermal energy is shown. The system comprises the heat mat 100 and either or both of the heat exchange elements 130, 131. The heat exchange elements 130, 131 are connected either directly or indirectly to with a second liquid (or gas) passing through them to remove or deliver energy as required. The heat exchange elements 130, 131 illustrate an application of the heat mat 100, although other applications will be apparent.

The heat energy transfer system illustrated in FIG. 7 may be used as either a heat energy collector or a heat energy emitter using the exterior surface 101. This is facilitated by the mounting of the two heat exchange elements 130, 131 to the heat mat main body 108. Only one of the heat exchange elements 130, 131 is used for each mode of operation of the system.

Each heat exchange element 130, 131 has a surface with an undulating profile, corresponding to the interior surface 102 of the heat mat main body 108, for maximising the transfer of heat energy from the heat mat to the heat exchange element 130, 131. This undulating surface forms a close fit with the undulating surface 102 of the heat mat main body 108. The interior surface 102 of the heat mat main body 108 is thermally coupled to the heat exchange elements 130, 131 using a thermal paste or gel. Each heat exchange element 130, 131 is then mechanically clamped onto the heat mat main body 108. For a permanent coupling, thermal adhesive may instead be used.

In order to use the heat mat 100 as a heat energy absorber, liquid or vapour at a temperature that is at least a few Kelvin lower than the heat mat main body 108 is passed through the upper, first heat exchange element 130. As the exterior surface 101 is heated by an external heat source typically. latent heat from the mass of the ambient air and/or solar energy absorption, the heat energy is transferred into the fluid through the ribs 122, 123, 124 of the phase-change portion 121 of the passages 103. The heat energy evaporates the working fluid, turning it from liquid to vapour through the absorption of latent heat of evaporation. This evaporation thus uses more heat energy than does heating without phase change. The heated vapour rises along the passages 103, mostly along the volume contained by the phase change portion 121, and condenses on the inner surface of the upper manifold 104 and/or the surface of the drain channel 120 of the passage 103. Upon condensing, the vapour releases the stored latent heat to the material of the heat mat 100 that is adjacent the drain channel 120 or the upper manifold 104. This heat energy is then transferred to the first heat exchange element 130 through conduction by the material of the heat mat main body 108 and/or the upper manifold 104. The condensed liquid travels down the drain channel 120, typically flowing along the internal surface of the passage 103, by the action of gravity. The liquid then collects at the bottom of the heat mat 100 in the reservoir of liquid phase fluid 140. The vaporization-condensation cycle can then repeat again. This effect causes the heat energy to be distributed substantially evenly across the entire exterior surface 101 of the heat mat main body 108, and prevents any significant temperature difference between the upper and lower parts of the heat mat 100. The upper and lower manifolds 104, 105 allow the communication of fluid laterally in the panel, and prevent any significant temperature difference between different locations along the width of the heat mat 100. Put another way, the heat mat 100 is approximately isothermal on each surface 101, 102, although there typically is a modest temperature difference between the exterior surface 101 and the interior surface 102. It also causes the efficient transfer of heat energy from the exterior surface 101 to the interior surface 102. The amount of heat energy that is transferred is significantly greater than can be achieved through conduction by an inexpensive metal of comparable weight and size to the heat mat 100. This is achieved without the use of any wicking structure or material.

In order to use the heat energy transfer system (i.e. the exterior surface 101) as a heat energy emitter, liquid or gas that is at a temperature least a few Kelvin higher than the heat mat main body 108 is passed through the lower, second heat exchange element 131. In this mode of operation, the heat energy is conducted through the interior surface 102 to the passages 103. This causes the working fluid in the cavity to change phase from liquid to vapour. The heated vapour travels up the passages 103 and condenses on the cooler ribs 122, 123, 124 of the phase-change portion 121 of the passages 103 and/or on the inner surfaces of the upper manifold 104. This releases the heat energy stored in the vapour into the material of the heat mat 100. This heat energy is then conducted to the (cooler) exterior surface 101. The condensed liquid then travels to the bottom of the cavity in the heat mat main body 108 under the influence of gravity and the vaporization-condensation cycle repeats again. The condensed fluid flows down the passages 103 in a manner that depends on the configuration of the passages 103 and the orientation of the heat mat 100, and may flow down the drain channel 120. However the condensed fluid flows, it does not significantly impede the flow of gas phase fluid up the passages 103. Experiments have shown that the heat mat 100 is almost as effective in this heat energy emitting mode of operation as it is in the heat energy absorbing mode of operation. The experiments show that it is significantly more effective than a corresponding arrangement in which circular profile passages are used. The better efficiency of heat transfer results from the configuration of the passages 103.

Experiments have shown that best performance is provided when the front surface 101 is hotter than the back surface 102, in which case the drain channel 120 serves to communicate condensate (liquid). This applies whether the heat mat 100 is arranged vertically, horizontally, or somewhere in between. Where the heat mat 100 is arranged horizontally, the lower surface 102 ordinarily will be lowermost, so that gravity facilitates the drain channel 120 carrying the condensate liquid.

The experiments have shown that the heat mat 100 also functions well with the temperature differential in the opposite direction.

An effect of the ribs 122, 123, 124 is to provide an increased surface area between the material of the heat mat main body 108 and part of the cavity that is the phase change portion of the passage 103. This improves the phase-change process as more heat can flow between the exterior surface 101 and the working fluid within the sealed chamber per unit time, compared to an arrangement that is absent of ribs. The surface area of the phase-change portion 121 is greater per unit volume than the surface area of the drain channel 120.

The profile of the passages is not limited to that shown in FIG. 4. For example, the main rib 124 can be narrower (whilst having the minimum width needed for mechanical stability and manufacturability). Optionally, one or more additional ribs could be provided in place. Similarly, the ribs 122 and 123 can also be narrower. The ribs may be of any suitable profile, for instance rectangular, square, triangular or convex rounded. They may alternatively have a more complex profile, such as a part-trefoil or part-clover-leaf profile. The features 122, 123 and 124 are ribs because they extend longitudinally along the length of the passages 103. If manufacturing allows, other internal features of the passages that change the surface area of the phase change portion may be used instead of ribs.

Because of the configuration of the heat mat 100, heat energy is readily exchanged between the exterior faces 101 and 102 of the heat mat 100 and the fluid within the passages 103. Heat transfer is a function of the thermal conductivity of the material used for the heat mat main body 108, but it is also a function of the profile of the passages and the relationship between them and the profiles of the interior and exterior surfaces 101, 102. For instance, the matching between the undulating profile of the interior surface 102 and the rounded profile of the drain channel 120 maximises thermal conduction therebetween whilst allowing a minimum wall thickness (e.g. 2 mm or 2,5 mm) to be maintained and whilst allowing the drain channel to have a shape that provides effective draining of the condensed liquid down the heat mat to the reservoir of liquid phase fluid 140. It also allows the quantity of material used in the main body 108 to be reduced for a given minimum wall thickness. The profile of the phase change portion 121 of the passages 103 maximises the transfer of heat energy from the exterior surface 101 to the passages whilst allowing the exterior surface 101 to be planar, whilst allowing a minimum wall thickness (e.g. 2 mm or 2.5 mm) to be maintained and whilst allowing relatively straightforward manufacture of the heat mat main body 108.

The formation of the passages 103 within the heat mat main body 108 and the use of the manifolds 104, 105 facilitates relatively straightforward sealing of the cavity including the passages 103 since only a single seal at each end of the passages 103 with the heat mat main body 108 is required. Furthermore, the arrangement of the heat mat 100 is very simple compared to that of WO2013/104884, which includes a number of external components. The compact and self-contained nature of the heat mat 100 also gives rise to improved resilience to externally applied forces and thus makes it less vulnerable to being damaged. This allows it to be used as a material in construction of a residence or other building.

A prototype has been constructed and tested. The prototype heat mat, manufactured from aluminium, had dimensions of 4000×180×10 mm and the working fluid used was ammonia.

The tests were undertaken using a purpose built enclosed insulated chamber. A heat exchanger covering approximately ten percent of the area of the heat mat, with a circulating water pipe circuit feeding a water tank, was thermally bonded and mounted to the sample heat mat for heat extraction. The heat exchanger was used to transfer heat energy into a water tank using a circulating water pipe circuit. The air in the chamber was not stirred during the tests.

The tests identified that, with a 13 K temperature differential between the heat mat working temperature and the circulating water inlet temperature, the prototype heat mat achieved a heat transfer rate of 1.47 $kW/m^2$. This rate of heat transfer is considerably higher than can be achieved with the majority of prior art arrangements.

The scope of the invention is not limited by the above-described embodiments and various alternatives will be apparent to the skilled person as being within the scope of the appended claims. Some such alternatives will now be described.

The exterior surface 101 may have fins extending from it, which increases the heat emitting surface area and improves the rate of heat transfer.

The ribs 122-124 are easy to manufacture by extrusion because they have a constant profile along the length of the passages 103. Instead, protrusions of other forms may be present in the passages. The protrusions may be domed, or they may be circumferential or helical ribs or may take any other suitable form, as permitted by the manufacturing process chosen for producing the heat mat body 108.

The heat mat 100 may be provided with a pressure relief valve that is operable to release some fluid when the internal pressure exceeds a threshold level. This provides improved safety since it reduces the risk of an uncontrolled rupture of the material of the heat mat 100.

The main body 108 and the manifolds 104, 105 advantageously are formed of aluminium, which is relatively inexpensive, has good anti-corrosion properties, and is easy to work in a manufacturing process. Alternatively, an aluminium alloy or another metal such as steel may be used.

Figure 9:
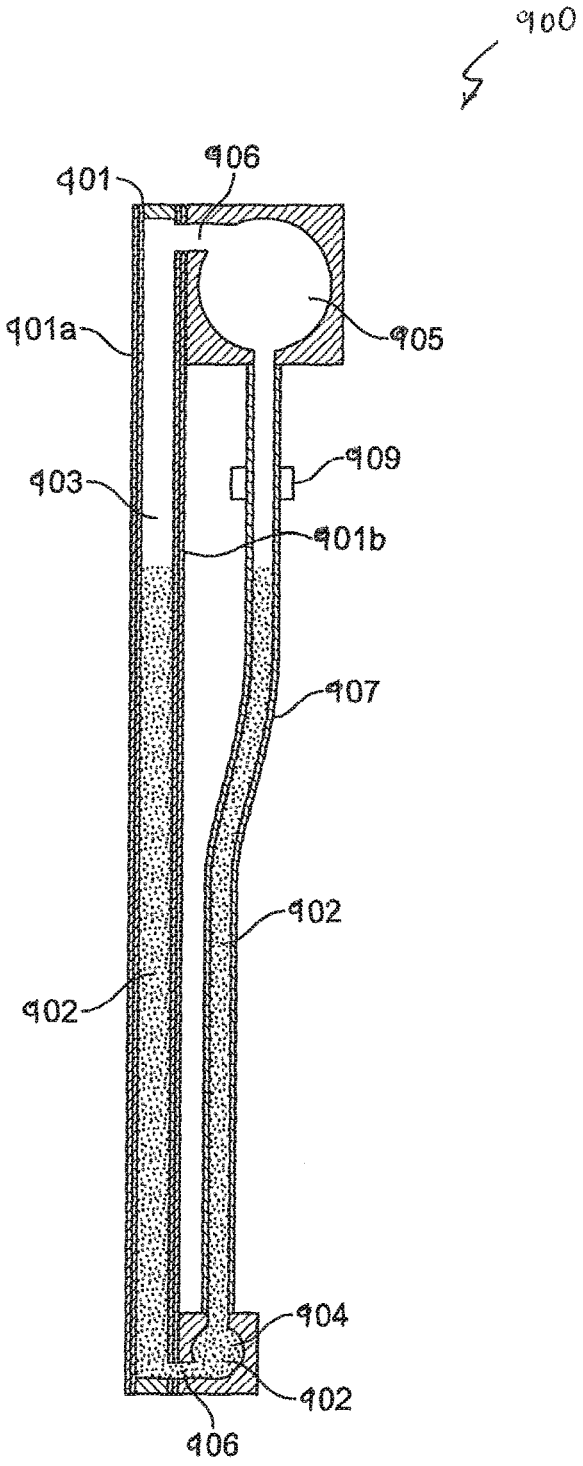
FIG. 9 is a prior art heat exchanger.

Instead of the first and second heat exchange elements 130,131 being external to the heat mat 100, either or both of the first and second heat exchange elements 130,131 can be provided internally within the heat mat. In this case, a cavity is provided at the appropriate end of the heat mat 100, for instance in the form of an enlarged manifold 104, 105, and the heat exchange element 130,131 extends into the heat mat 100 and through the cavity so as to allow the transfer of heat energy from the fluid in the heat mat 100 to the fluid passing through the heat exchange element 130, 131. Alternatively, a heat exchange arrangement like that shown in the prior art FIG. 9 may be suitable (although without the duct 902). Such arrangements require sealing where conduits of the heat exchange element 130,131 enter the heat mat 100 and may not allow straightforward removal of the heat mat 100 from the heat exchange elements 130, 131.

In an alternative embodiment, the heat mat 100 can also be operated in the horizontal position. The heat mat boo in FIG. 7 can be mounted horizontally or approximately with the smooth surface 101 facing upwards. When the heat mat 100 is operating as a heat emitter, heated fluid is fed into the heat exchange element 131, which is located at one end or side of the heat mat 100 and thermally coupled to the lower surface 102.

The heat from the working fluid is conducted to the heat mat 100 through the lower surface 102, which causes the working fluid contained within the heat mat 100 to phase-change from liquid into vapour. The heated vapour rises within the passage width and condenses on a surface of the phase-change portion 121 of the passages 103. As the vapour condenses, heat energy is released and transferred to the outer surface 101 of the heat mat 100. The condensed fluid is carried back towards the heat exchange element 131 by gas pressure resulting from the evaporation-condensation cycle within the heat mat 100.

Such a heat mat 100 used as a heat emitter can provide a hot surface for keeping cooked food warm. By applying cold fluid through the heat exchange element 130, the heat mat 100 can be refrigerated, to provide a cold surface for preparation of raw or cooked food for instance. In either case, a thermostat may be used in a control circuit to maintain the heat mat 100 at a required temperature.

The invention claimed is:

1. Apparatus comprising:

a panel having first and second main faces; and a sealed system internal within the panel and comprising:

a first manifold cavity at a first end of the panel;

a second manifold cavity at a second end of the panel; and plural passages, each of the plural passages extending from the first manifold cavity to the second manifold cavity, wherein the sealed system contains a fluid in both gas and liquid states, each of the plural passages defines a phase-change portion and a drain portion, the phase-change portion and the drain portion are adjacently located and extend along the passage and for each of the plural passages:

the phase-change portion is closer to the first main face than it is to the second main face, the phase-change portion has a profile that includes one or more protruding features at least one of which extends away from the first main face, the drain portion is closer to the second main face than it is to the first main face, and the drain portion has a profile that is absent of protruding features.

2. Apparatus as claimed in claim 1, wherein the one or more protruding features include one or more ribs extending lengthways in the passages.

3. Apparatus as claimed in claim 2, wherein at least one of the one or more ribs is triangular.

4. Apparatus as claimed in claim 2, wherein at least one of the one or more ribs is square.

5. Apparatus as claimed in claim 1, wherein:

the second main face includes undulations having peaks and troughs, the peaks of the undulations of the second main face coincide with the passages, and the troughs of the undulations of the second main face correspond to positions between the passages.

6. Apparatus as claimed in claim 5, wherein a thickness of the panel between the first main face and the second main face is greater at locations that correspond to locations of the passages compared to locations that do not correspond to locations of the passages.

7. Apparatus as claimed in claim 5, wherein the undulations have a sinusoidal cross section.

8. Apparatus as claimed in claim 1, wherein a main body of the panel is formed of extruded material.

9. Apparatus as claimed in claim 1, wherein a main body of the panel is aluminium or an aluminium alloy.

10. Apparatus as claimed in claim 1, wherein the panel comprises a main body and wherein first and second manifold components, which contribute to defining the first and second manifold cavities, are coupled to the main body.

11. Apparatus as claimed in claim 1, wherein a cross sectional area of the first and second manifold cavities is 50-200% of a cross sectional area of the passages.

12. Apparatus as claimed in claim 1, comprising a first heat exchanger element thermally coupled to one of the first main face and the second main face of the panel and adjacent the first end of the panel.

13. Apparatus as claimed in claim 1, comprising a second heat exchanger element thermally coupled to the one of the first main face and the second main face of the panel and adjacent the second end of the panel.

14. Apparatus as claimed in claim 12, wherein an area of coupling between the first heat exchanger element and the panel constitutes 5-40% of a surface area of one of the first main face and the second main face of the panel to which the heat exchanger element is coupled.

15. Apparatus as claimed in claim 12, wherein the first heat exchanger element is coupled to the second main face of the panel.

16. Apparatus comprising:

a panel having first and second main faces; and a sealed system internal within the panel and comprising:

a first manifold cavity at a first end of the panel;

a second manifold cavity at a second end of the panel; and plural passages, each of the plural passages extending from the first manifold cavity to the second manifold cavity, wherein the sealed system contains a fluid in both gas and liquid states, each of the plural passages defines a phase-change portion and a drain portion, the phase-change portion and the drain portion are adjacently located and extend along the passage, and for each of the passages:

the phase-change portion is closer to the first main face than it is to the second main face, the phase-change portion has a profile that includes:

one or more protruding features at least one of which extends away from the first main face, and first and second ribs, each extending inwardly with respect to a boundary of the passage, wherein the first and second ribs partially close the drain portion from the phase-change portion, and the drain portion is closer to the second main face than it is to the first main face, and the drain portion has a profile that is absent of protruding features.

17. Apparatus as claimed in claim 16, wherein the first and second ribs are substantially triangular in cross-section.

18. Apparatus as claimed in claim 16, wherein the one or more protruding features includes a square rib.

19. Apparatus as claimed in claim 16, wherein corners of the first and second ribs are filleted.

20. Apparatus as claimed in claim 16, wherein the first and second ribs shelter the drain channel from turbulence in the phase-change portion.

* * * * *